United States Patent [19]

Goldstein

[11] Patent Number: 4,527,721

[45] Date of Patent: Jul. 9, 1985

[54] COMBINATION CARRYING SLED AND BEACH UMBRELLA

[76] Inventor: Richard M. Goldstein, 114 Barberry La., East Hills, N.Y. 11577

[21] Appl. No.: 428,693

[22] Filed: Sep. 30, 1982

[51] Int. Cl.[3] ..... A45B 3/00

[52] U.S. Cl. ..... 224/151; 135/16

[58] Field of Search ..... 135/16, 19, 20 R, 85, 135/31; D3/5; 2/4, 184.5, 191

[56] References Cited

U.S. PATENT DOCUMENTS 1,819,912 8/1931 McGaffey ..... 135/16
1,838,986 12/1931 Callender ..... 135/85

FOREIGN PATENT DOCUMENTS 161467 4/1921 United Kingdom ..... 135/20 R

*Primary Examiner*—Steven M. Pollard
*Assistant Examiner*—David Voorhees
*Attorney, Agent, or Firm*—Jay M. Cantor

[57] ABSTRACT

A carrying sled capable of conversion into a beach umbrella. The carrying sled includes a rigid dish-shaped member with wheels or rails on the dish convex surface. An annular flexible material is secured to and along the outer edge of the dish and includes a draw string positioned around and secured in the outer edge of the flexible material for drawing up the flexible material when desired. Pockets are formed at the outer edges of the flexible material for receiving a spoke disposable therein and passing through a tunnel member on the convex side of the dish for maintaining the flexible material in an outwardly extending position from the edge of the dish. A pole member is secured to the center portion of the concave side of the dish, at the pole either being of the telescoping type or formed by plural interconnecting pole members. In the case of the latter, the remaining ones of the interconnectable members are secured to the concave side of the dish when not in use. With the spokes properly assembled and pole in the extended position, the structure operates as a beach umbrella. Upon collapsing of the pole and removal of the spokes, the dish will act as a carrying sled resting upon the wheels or rails with the draw string being tightened to enclose items to be carried between the dish and the flexible material.

15 Claims, 4 Drawing Figures

Fig. 1
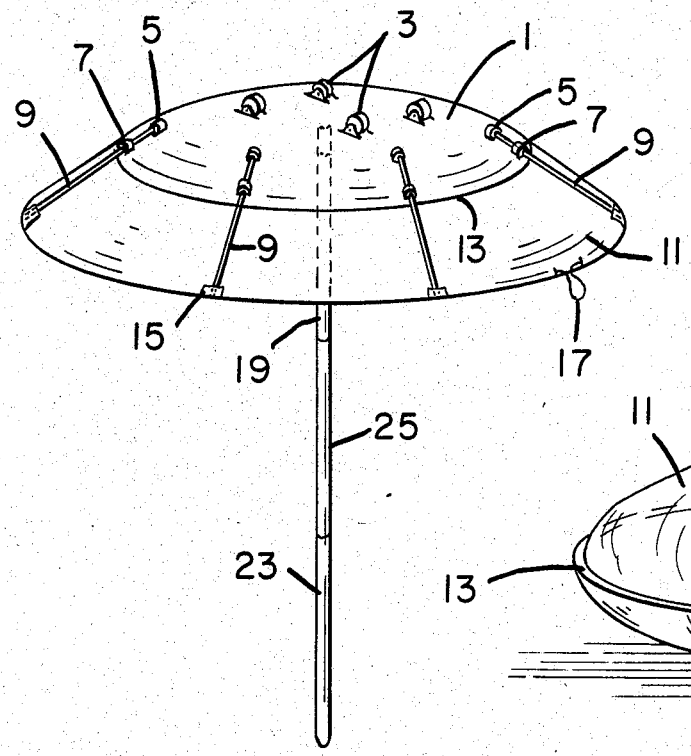
Fig. 2
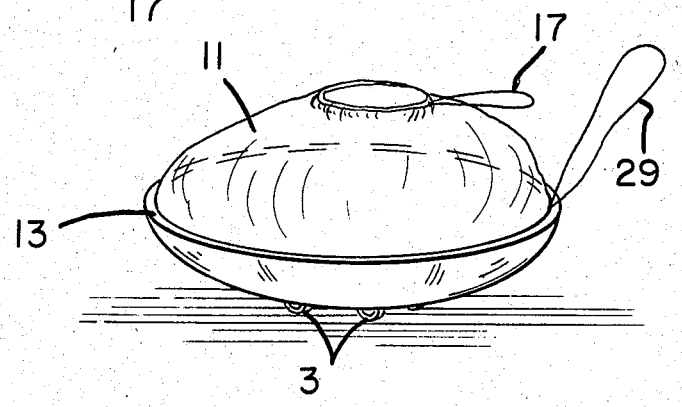
Fig. 3
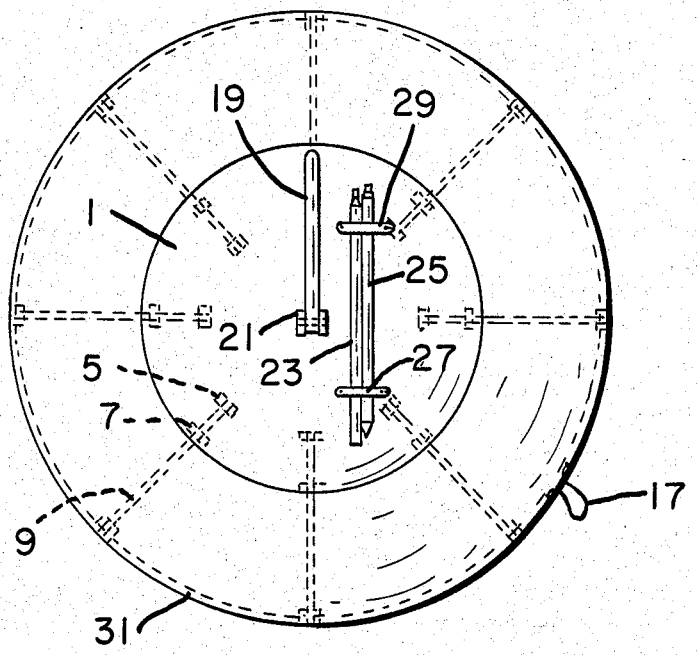
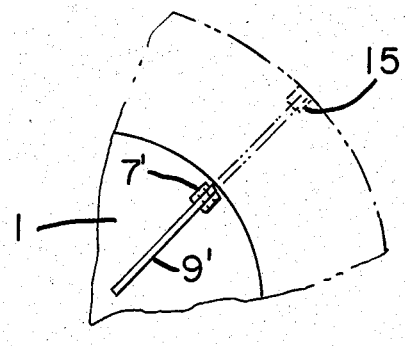
Fig. 4

COMBINATION CARRYING SLED AND BEACH UMBRELLA

FIELD OF THE INVENTION

This invention relates to a combination carrying sled and beach umbrella.

DESCRIPTION OF THE PRIOR ART

For many decades up to the present, denizens of our beaches have had the difficult task of carrying beach umbrellas as well as all other desirable paraphernalia, such as cold packs, towels, radios, small beach chairs and the like, from homes or automobiles over the sand and onto the beach. This has been quite cumbersome due to the bulkiness of beach umbrellas as well as the other paraphernalia required. Normally, the bulky umbrella is carried as a separate item and the remaining paraphernalia is carried in a tote bag or the like separately. It is the purpose of this invention to provide an inexpensive device which can provide the function of both the prior art umbrella and the prior art tote bag in a single unit in a simple and inexpensive manner.

SUMMARY OF THE INVENTION

In accordance with the present invention, there is provided a carrying sled capable of conversion into a beach umbrella. The carrying sled includes a rigid dish-shaped member with wheels or rails on the dish convex surface. An annular flexible material is secured to and along the outer edge of the dish and includes a draw string positioned around and secured in the outer edge of the flexible material for drawing up the flexible material when desired. Pockets are formed at the outer edges of the flexible material for receiving a spoke disposable therein and passing through a tunnel member on the convex side of the dish for maintaining the flexible material in an outwardly extending position from the edge of the dish. A pole member is secured to the center portion of the concave side of the dish, the pole either being of the telescoping type or formed by plural interconnecting pole members. In the case of the latter, the remaining ones of the interconnectable members are secured to the concave side of the dish when not in use. With the spokes properly assembled and pole in the extended position, the structure operates as a beach umbrella. Upon collapsing of the pole and removal of the spokes, the dish will act as a carrying sled resting upon the wheels or rails with the draw string being tightened to enclose items to be carried between the dish and the flexible material.

BRIEF DESCRIPTION OF THE DRAWINGS

FIG. 1 is an elevational view of the combination carrying sled and beach umbrella in accordance with the present invention assembled as a beach umbrella;

FIG. 2 is an elevational view of the device of FIG. 1 assembled as a carrying sled;

FIG. 3 is a bottom view of the combination carrying sled and beach umbrella assembled as in FIG. 1 but with the pole elements in the stored position; and FIG. 4 is an alternative embodiment of the spokes in accordance with the present invention.

DESCRIPTION OF THE PREFERRED EMBODIMENT

Referring first to FIG. 1, there is shown the combination carrying sled and beach umbrella assembled as a beach umbrella in accordance with the present invention. The combination includes a rigid dish-shaped member 1 which can be formed of aluminum, magnesium, a rigid foam or plastic material, such as polyurethane, polystyrene or the like, and which has affixed thereto a plurality of wheels or rollers 3. The wheels can be rotatable in fixed axles secured to the dish 1 as shown or, alternatively, the wheels can be secured to pivotable axles (not shown) or completely replaced by sled rails. A plurality of tunnels 5 and 7 are formed on the outer surface of the dish 1 and have aligned apertures extending therethrough for receipt of rigid spokes 9. The aperture through the tunnel 7 passes completely therethrough whereas the aperture in tunnel 5 only passes partially therethrough to secure the spoke 9 therein. The tunnel pairs 5 and 7 are positioned and are preferably evenly spaced along radii from the center of the dish. In the embodiment shown, as best seen in FIG. 3, the spacing is 45 degrees of arc between spokes.

A flexible annular cape 11 of nylon, canvass or the like having an open center portion is secured to the outer edge 13 of the dish 1 there being pockets 15 formed at the outer edge of the flexible material 11 for receiving spokes 9.

As an alternative to pockets 15, a sleeve can be provided which extends from the outer edge of the cape 11 inwardly along the cape radius either entirely across the cape or partially across the cape. The sleeve end on the inner side of the cape would be open to receive a spoke whereas the other or outer sleeve end would be closed to retain a spoke within the sleeve.

There is also provided a slot 31 (FIG. 3) around the outer edge of the flexible member 11 for receiving a string 17, a portion of the string being shown extending outwardly from the slot for use as will be described hereinbelow. A pole member 19 is pivotally secured at pivot and axle 21 at the concave or underside of the dish 1. The pole 19 can be rotated to a position normal to the dish 1 and locked in that position by locking means (not shown) of well known type. The pole 19 is secured to other interconnecting pole members 21 and 23 as shown in FIG. 1, these pole members being storable on the concave surface of the dish 1 as shown in FIG. 3 within straps 27 and 29 secured to the underside of the dish 1. A telescoped pole could be used at 19 in place of the pole as shown. It should also be noted that the spokes 9 can be stored on the under surface of the dish 1 when not in use. It can be seen that by positioning of the spokes 9 through the tunnels 5 and in the tunnels 7 and the pockets 15 at all positions around the dish 1 and cape 11, there is provided an umbrella structure. The pole 19 is positioned for insertion into the ground by rotation thereof to the position as shown in FIG. 1 with subsequent locking of the pole in that position and insertion of the remaining pole members 23 and 25 therein as shown in FIG. 1.

In order to utilize the umbrella as shown in FIGS. 1 and 3 as a carrying sled, the spokes 9 are disassembled by removal of the spoke ends from tunnels 5 and subsequent movement of the spokes through tunnels 7. The pole members 19, 23 and 25 are dissassembled with the pole member 19 being rotated against the dish 1 as shown in FIG. 3 after removal of the locking means (not shown). The remaining pole members 23 and 25 can be stored as shown in FIG. 3 and the spokes 9, if desired, can also be placed in the bottom of the dish 1. In this condition, the cape 11 being flexible, upon applying a force on the string 17, the edges of the cape will come together as shown in FIG. 2. It can be seen in FIG. 2 that the cape is still attached to the dish at 13. However, the outer edge of the cape 11 has been pulled together due to the force on the string 17 to provide a small opening (or no opening whatsoever, if desired) at the top surface of the carrying sled. It can also be seen that the dish 1 is now resting on the wheels 3. When the beach accessories have been positioned on the dish 1 and within the cape 11 in the assembly as shown in FIG. 2, the sled can then be moved along the beach, street or the like by applying a suitable force on the string 17 or on an alternative pulling member 29 as shown in FIG. 2 or by means of the pole portion 19.

Referring now to FIG. 4, there is shown a second embodiment of the spoke and tunnel arrangement. In the case of FIG. 4 a spoke 9', similar to the spoke 9 of FIGS. 1 and 3 is provided with a single tunnel 7' in FIG. 4. The tunnel 7' is secured to the spoke 9' and is rotatable in the base of the dish 1. Upon rotation of the spoke 9' to the position shown in phantom, the spoke 9' can be positioned in the pocket 15. This can be accomplished either by having a slightly flexible spoke 9' or by having a cape 11 which is sufficiently flexible so that it can be pulled over the spoke 9'. In this manner, the spoke can be at all times secured to the dish 1.

As a further embodiment, the cape 11 can be replaced by a dish-shaped flexible member identical to the cape but with the flexible material including the entire open center region of cape 11. Slots would be cut in this cape to permit the wheels 3 and the tunnels 5 and 7 to pass therethrough. Means can be provided to secure the cape to the dish 1 to prevent sliding of the cape and dish relative to each other.

As a still further embodiment, the wheels can be removably attached to means of a plate to a receiving bracket secured to the underside of the dish. As mentioned above, the rails can be provided as well, if desired, in which event the wheels should be extended below the rails.

It can be seen that there has been provided a simple and inexpensive combination carrying sled and beach umbrella capable of providing the functions of each.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

What is claimed is:

1. A combination umbrella and carrier which comprises:

(a) a thin rigid concave member having a continuous outer perimeter, (b) a thin flexible member secured relative to one surface of said rigid member and extending beyond and about said perimeter (c) plural removable support means securable to said rigid member and said flexible member for supportably extending said flexible member beyond the perimeter of said rigid member, (d) means disposed in the outer perimeter region of said flexible member and responsive to a predetermined force thereon for drawing together the perimeter region of said flexible member to form a substantially closed cover for the concave side of the rigid member, and (e) means on the concave surface of said rigid member for receiving a pole.

2. A combination as set forth in claim 1 further including one of wheels or rails secured to said one surface of said rigid member.

3. A combination as set forth in claim 1 wherein said support means includes a sleeve disposed on said flexible member, a rigid spoke positioned in said sleeve and extending therein to a point closely adjacent the outer perimeter thereof and means on said rigid member for securing said spoke thereto.

4. A combination as set forth in claim 2 wherein said support means includes a sleeve disposed on said flexible member, a rigid spoke positioned in said sleeve and extending therein to a point closely adjacent the outer perimeter thereof and means on said rigid member for securing said spoke thereto.

5. A combination as set forth in claim 3 wherein said flexible member further includes a slot extending about the outer perimeter thereof and a draw string disposed in said slot about said perimeter and extending out of said slot at one location.

6. A combination as set forth in claim 2 wherein said flexible member further includes a slot extending about the outer perimeter thereof and a draw string disposed in said slot about said perimeter and extending out of said slot at one location.

7. A combination as set forth in claim 1 wherein said thin rigid member is dish-shaped and said thin flexible member is an annulus secured around the perimeter of said rigid member.

8. A combination as set forth in claim 7 further including one of wheels or rails secured to said one surface of said rigid member.

9. A combination as set forth in claim 7 wherein said support means includes a sleeve disposed on said flexible member, a rigid spoke positioned in said sleeve and extending therein to a point closely adjacent the outer perimeter thereof and means on said rigid member for securing said spoke thereto.

10. A combination as set forth in claim 8 wherein said support means includes a sleeve disposed on said flexible member, a rigid spoke positioned in said sleeve and extending therein to a point closely adjacent the outer perimeter thereof and means on said rigid member for securing said spoke thereto.

11. A combination as set forth in claim 9 wherein said flexible member further includes a slot extending about the outer perimeter thereof and a draw string disposed in said slot about said perimeter and extending out of said slot at one location.

12. A combination as set forth in claim 8 wherein said flexible member further includes a slot extending about the outer perimeter thereof and a draw string disposed in said slot about said perimeter and extending out of said slot at one location.

13. A carrier which comprises:

(a) a thin rigid concave member having a continuous perimeter, (b) a thin flexible member secured relative to one surface of said rigid member and extending beyond said perimeter at all portions thereof, (c) means disposed in the outer perimeter region of said flexible member and responsive to a predetermined force thereon for drawing together the perimeter region of said flexible member so as to cause the flexible member to extend across the concavity of the rigid member, and (d) at least one of wheels or rails secured to said one surface of said rigid member.

14. A carrier as set forth in claim 13 wherein wheels are secured to said rigid member, including wheel means and means secured to said one surface of said rigid member for removably securing said wheel means to said rigid member.

15. A carrier as set forth in claim 14 wherein rail means is secured to said one surface of said rigid member, said wheels extending outwardly from said one surface beyond said rail means.

* * * * *